United States Patent [19]

Somerville

[11] 4,256,406

[45] Mar. 17, 1981

[54] AGITATOR AND DRIVING MEANS THEREFOR

[76] Inventor: Robert L. Somerville, Old Amwell Rd., Rte. 1, Box 256, Neshanic, N.J. 08853

[21] Appl. No.: 77,128

[22] Filed: Sep. 19, 1979

[51] Int. Cl.[3] ..... B01F 7/20

[52] U.S. Cl. ..... 366/279; 64/23.6

[58] Field of Search ..... 366/244, 245, 249, 250, 366/251, 279, 282, 286; 64/23.6, 23, 23.5; 417/363, 424

[56] References Cited

U.S. PATENT DOCUMENTS

| | | | |
|---|---|---|---|
| 2,830,801 | 4/1958 | Stratienko et al. | 366/249 |
| 3,115,333 | 12/1963 | Lennon | 366/286 |
| 3,297,309 | 1/1967 | Adams | 366/282 X |

*Primary Examiner*—Edward L. Roberts

*Attorney, Agent, or Firm*—Eugene E. Geoffrey, Jr.

[57] ABSTRACT

Driving means for agitators and other devices having vertically disposed driven shafts which includes an intermediate shaft carried by bearings capable of withstanding thrust and radial loads, a coupling connecting the driven shaft to the lower end of said intermediate shaft, a coupling on the upper end of the intermediate shaft and a drive motor having a downwardly extending driven shaft engaging the coupling on the upper end of the intermediate shaft and a mounting for said motor to permit displacement thereof in a plane normal to said intermediate shaft.

10 Claims, 6 Drawing Figures

AGITATOR AND DRIVING MEANS THEREFOR

This invention relates to agitators of the type generally used in commercial applications and more specifically to a novel and improved agitator drive which is characterized by its simplicity, durability and relatively wide range of speed control.

Commercial agitators are used in a wide variety of physical and chemical processes and agitator tanks are often as large as twenty feet in diameter and incorporate two or more agitator blades on a central shaft which blades are of the order of five to six feet in diameter and even larger. It is apparent that with agitators of such magnitudes the power required may range upwardly from as much as 80 horsepower to rotate the agitator blades at a speed of 70 rpm. It is evident however that the power required is not only a function of the speed at which the blades are to be rotated but also the viscosity of the fluid being agitated.

Heretofore, it has been customary to utilize electric drive motors functioning through an appropriate gear box having an output flange to which the flanged shaft of the agitator is coupled. The gear box for reducing the motor speed to the desired agitator speed was also a relatively complicated and expensive structure in that the tendency for the agitator shaft to wobble placed substantial stresses on the speed reducing assembly for driving the agitator shaft. Accordingly, the speed reducing assembly of necessity was required to include appropriate means by way of flexible couplings or the like to prevent bending stresses from adversely affecting the reducing gears. Even then, considerable difficulty has been entailed with known devices which were not only expensive to repair or replace but resulted in considerable down time for the agitator.

This invention overcomes the difficulties heretofore encountered in driving relatively large agitators and utilizes a hydraulic motor together with novel and improved means for coupling the motor to the agitator shaft and at the same time supporting the agitator shaft without the need for complicated flexible or universal joints to prevent damage to the hydraulic motor. With the apparatus in accordance with the invention, the agitator shaft is accurately aligned with an intermediate shaft coupling the agitator shaft to the motor. The intermediate shaft is supported in such a manner that bending stresses which may adversely affect the motor are maintained at a mininum and through a novel and improved motor mount and means for coupling the motor to the intermediate shaft, the bending stresses have negligible adverse effect on the motor.

Another object of the invention resides in the provision of a novel and improved hydraulic motor mount for driving agitators of the type described above which is characterized by its simplicity, effectiveness and ease of maintenance.

Still another object of the invention resides in the provision of a novel and improved intermediate shaft and mounting therefor which affords a direct coupling of the agitator shaft to the motor and at the same time provides support for the agitator shaft and minimizes bending stresses at the coupling of the intermediate shaft to the drive motor.

The agitator and driving means therefor in accordance with the invention comprises an intermediate drive shaft which is supported by a pair of spaced spherical bearings which will withstand both thrust and radial loads. The agitator shaft is coupled to the lower end of the intermediate shaft utilizing coupling means surrounding the intermediate and agitator shafts for firmly engaging the shafts and thus provide precise alignment of the agitator shaft with the intermediate shaft and at the same time firmly support the agitator shaft. By reason of the nature of the bearing assemblies, bending stresses which produce some deflection of the intermediate shaft at a point between the supporting bearings will not adversely affect the bearings and the bending deviations at the driven end of the intermediate shaft are relatively small. The hydraulic drive motor is supported on a shelf positioned above the driven end of the intermediate shaft and the motor is carried by a plate resting on the shelf and which plate is movable relative to the shelf to provide self alignment of the motor shaft with the driven end of the intermediate shaft. By minimizing friction between the motor mounting plate and the shelf, it has been found that stresses on the motor shaft are negligible with a result that maintenance problems were materially reduced.

The above and other objects and advantages of the invention will become apparent from the following description and accompanying drawings forming part of this application.

IN THE DRAWINGS

Figure 1:
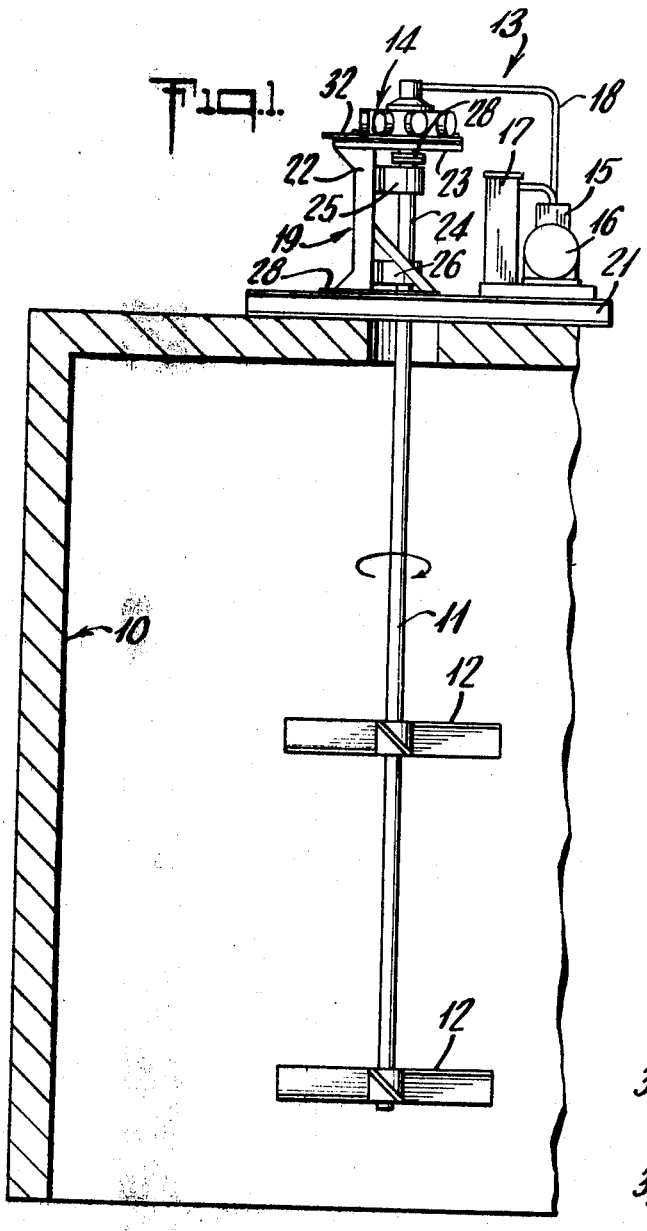
FIG. 1 is a side elevational view in partial section of an agitator and driving means therefor in accordance with the invention.

Referring now to the drawings and more specifically to FIG. 1, the agitator tank is generally denoted by the numeral 10 which has a central agitator shaft 11 carrying the agitator blades 12. The driving means in accordance with the invention is generally denoted by the numeral 13 and includes the hydraulic drive motor 14, the liquid compressor 15, electric motor 16 and control cabinet 17. The compressor 15 is coupled to the motor 14 by feed and return hoses generally denoted by the numeral 18. Since this equipment is well known in the art, a more detailed description is not deemed necessary.

Figure 3:
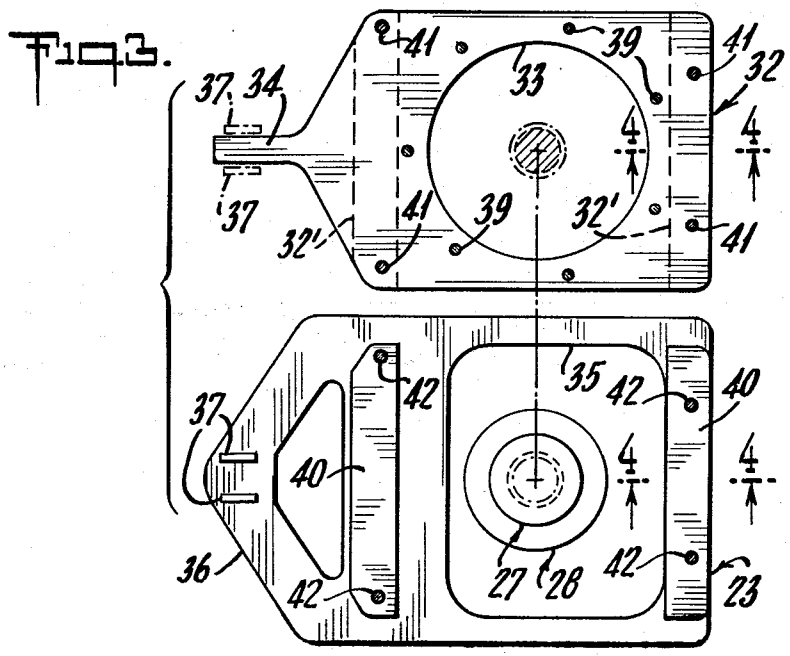
FIG. 3 illustrates plan views of the motor mounting plate and the motor supporting shelf taken in the direction of the arrows 3—3 of FIG. 2.
Figure 4:
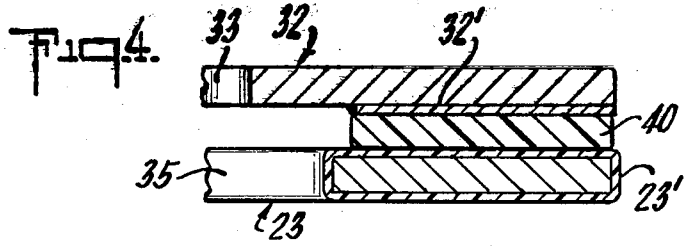
FIG. 4 is an enlarged cross sectional view of a fragmentary portion of FIG. 3 taken along the lines 4—4 of FIG. 3.
Figure 2:
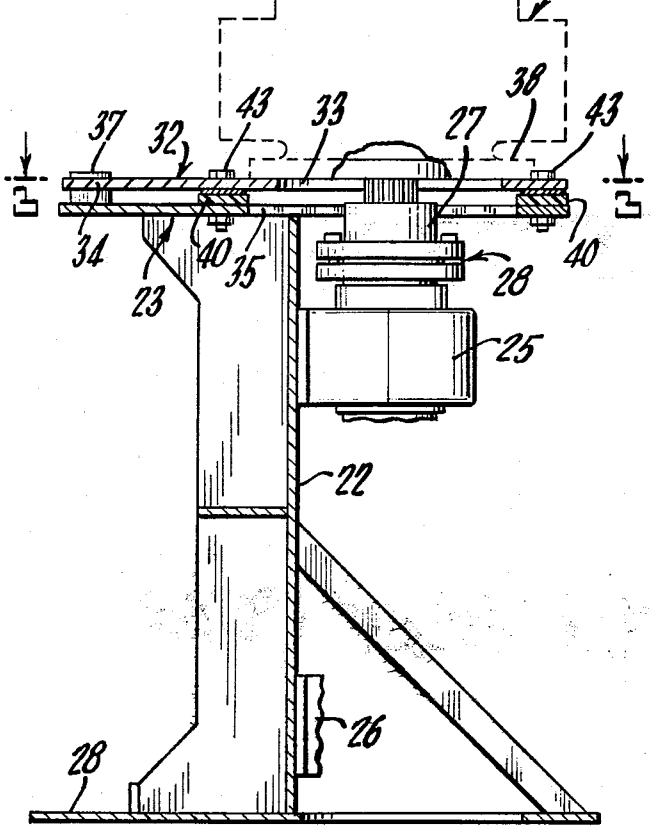
FIG. 2 is an enlarged fragmentary portion of FIG. 1 in partial section illustrating the motor mount and its coupling with the driven end of the intermediate shaft.

The hydraulic motor 14 is supported by a stand 19 having a base 20 supported by a pair of spaced I-beams 21, an upright support or column 22 and a top shelf or plate 23. A plan view of the shelf 23 is illustrated more clearly in FIGS. 2 and 3.

Figure 5:
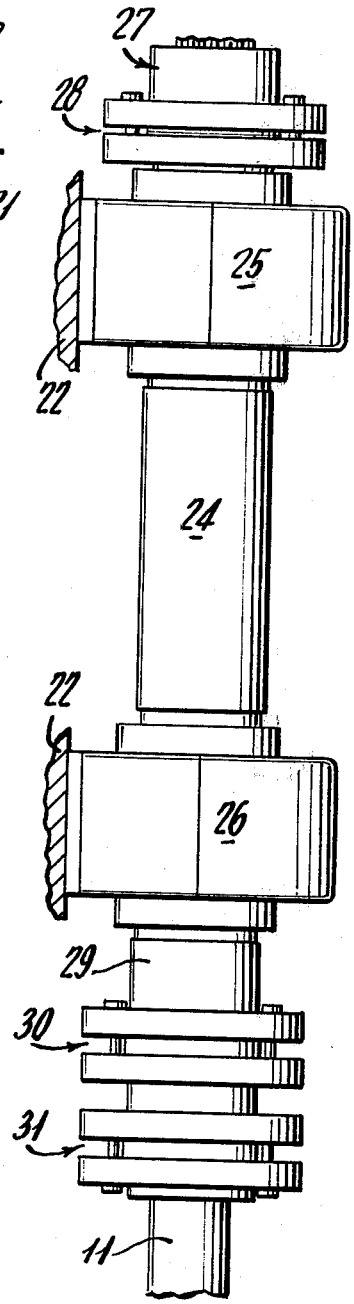
FIG. 5 is an enlarged elevational view of the intermediate shaft and bearings therefor.

The upright member or column 22 of the stand 19 carries an intermediate shaft 24 as viewed more clearly in FIG. 5 and is supported in a vertical position on the column 22 of the stand 19 by a pair of bearings 25 and 26. As will be described, the bearings 25 and 26 are spherical roller bearings with the bearing 25 functioning to maintain the vertical position of the shaft 24 and the bearing 26 including means for axial shifting of the lower portion of the shaft 24 which may occur by reason of temperatuure changes and the like. A coupling 27 is carried on the upper end of the shaft 24 and held in position by a shrink disc assembly generally denoted by the numeral 28. The lower end of the shaft 24 is coupled to the agitator shaft 11 by means of a sleeve 29 and a pair of shrink disc assemblies 30 and 31. The intermediate shaft, associated bearings and couplings will be described in greater detail in connection with FIG. 6.

As previously pointed out, the agitator shaft 11 is subject to a bending moment and in as much as it is firmly carried by the intermediate shaft that bending moment will be reflected by the shaft 24 and a portion of that deviation will be evident at the upper coupling carried by the intermediate shaft 24. Accordingly, the bearings are arranged to withstand radial loads as well as thrust loads. In order to compensate for this slight deviation when coupling the hydraulic drive motor 14 thereto, the latter is carried by a mounting plate 32 shown more clearly in FIG. 3 which overlies the plate or shelf 23 and is movable relative thereto. Plate 23 preferably includes a plastic coating 23'. More specifically, the mounting plate or shelf 32 has an enlarged central opening 33 and an arm 34 projecting from one side thereof. The plate or shelf 23 forming part of the stand 19 has an enlarged rectangular opening 35 and a triangularly shaped portion 36 extending from one end thereof and carrying a pair of upwardly extending ears 37 which engage the arm 34 of the mounting plate 32. The drive motor 14 is secured to the top side of the plate 32 by means of a plurality of bolts extending through the mounting flange 38 of the motor 14 and engaging holes 39 in the plate 32. A pair of strips of material 40 having a low coefficient of friction are held in position on the surface of the plate 23. While these strips 40 may be of any suitable material, it has been found that teflon is satisfactory. In addition, polished metal strips 32' of stainless steel or the like are carried on the underside of plate 32 and overlie the strips 40. With this arrangement, the motor 14 together with the mounting plate 32 is placed in position on the plate 23 and bolts are inserted through the openings 41 in the plate 32 and engage aligned openings 42 in the plate 23. These openings also extend through the strips of material 40. The openings 42 in the plate 23 and the openings 41 in the plate 32 are made slightly larger in diameter than the bolts 43 so that plate 32 can move relative to plate 23. This procedure allows a slight displacement of the plate 32 relative to the plate 23. Therefore, the bolts 43 utilized for this purpose are not tightened but are in fact only lightly tightened so that horizontal displacement of the plates can be effected while at the same time the motor 14 is securely retained in position.

Figure 6:
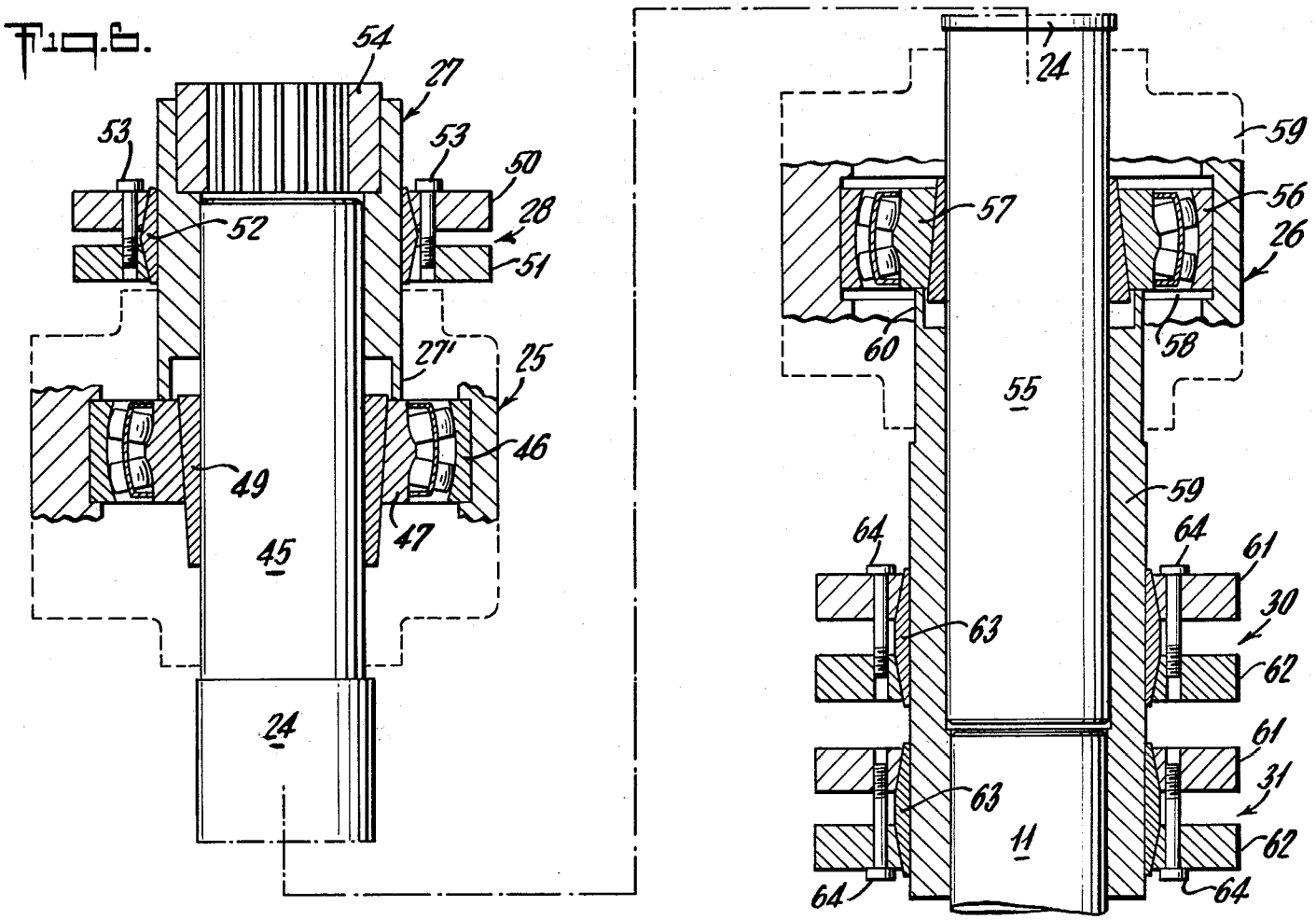
FIG. 6 is a further enlarged cross sectional view of FIG. 5.

Reference is now made to FIG. 6 of the drawings which is an enlarged view of FIG. 5 in partial section to illustrate the intermediate shaft and coupling members in detail.

The upper portion 45 of the intermediate shaft 24 is of slightly reduced diameter and extends through the spherical bearing 25. It will be observed that the races 46 and 47 of the bearings 25 are held firmly in position by the housing 48 in order to maintain the vertical position of the intermediate shaft 24. A wedge 49, disposed between the inner race 47 and the shaft portion 45, prevents downward motion of the shaft 24.

The upper end of the portion 25 of shaft 24 carries a coupling member 27 which is secured to the shaft portion 25 by the shrink disc assembly 28 which includes upper and lower discs 50 and 51 having tapered inner surfaces which engage a double tapered ring 52. Bolts 53 clamp the discs 50 and 51 together and in so doing shrink the double tapered ring 52 which in turn contracts the coupling about the shaft portion 45 and provides a firm friction coupling therebetween. A splined socket 54 is fixed in the upper end of the coupling 27 by any suitable means such as welding, shrink fitting or the like. With this arrangement, the splined member 54 and the coupling 27 will be aligned precisely with the shaft 24.

The lower portion 55 of the shaft 24 is also of slightly reduced section and is carried by the spherical bearing 26. The bearing 26 has races 56 and 57 and it will be observed that they are disposed in a recess 58 within the bearing housing 59 which is slightly wider than the races. This arrangement permits a slight shift of the races 56 and 57 within the housing 59 to compensate for slight elongation or contraction of the shaft 24 which would place unnecessary stress on one or the other of the bearings. A coupling sleeve 59 engages the shaft portion 55 and has an upwardly extending portion 60 of reduced section which bears against the underside of the race 57. The portion 60 and a corresponding portion 27' on the coupling member 27 which bears against the race 47 of the bearing 25 maintains the shaft 24 in a preselected position relative to the bearings.

The coupling member 55 is secured to the shaft portion 55 by a shrink disc assembly 30 substantially identical to that utilized to maintain the coupling 27 in engagement with the upper portion 45 of the shaft. The agitator shaft 11 extends into the coupling 59 and is held in position therein by a second shrink disc assembly 31. This method of coupling maintains precise alignment of the shaft 11 with the shaft 24 and at the same time permits ready disengagement of the shaft if necessary. The shrink disc assemblies 30 and 31 each includes upper and lower discs 61 and 62 having tapered inner surfaces and a double tapered ring 63. A plurality of bolts engage discs 61 and 62 and force them together in order to contract the ring 63 and in turn contract the coupling 59 to maintain it in engagement with the shaft portion 55 and the agitator shaft 11.

With this arrangement as described above, the utilization of a hydraulic drive motor for rotating an agitator affords agitator speed variations over a relatively wide range without the need for speed reducing mechanisms as previously discussed. The utilization of the intermediate shaft 24 fixedly mounted by a pair of bearings 25 and 26 provides a firm and secure support for the agitator 11, 12 and prevents the application of unnecessary stresses on the driving means caused by both the weight of the agitator assembly as well as bending moments which may be caused thereby. The utilization of the novel and improved mounting means for the drive motor 14 which involves a splined coupling for engaging the shaft of the drive motor and a drive motor mounting plate 32 which can shift in any radial direction relative to the axis of the shaft 24 through a preselected distance effects automatic alignment of the shaft of the motor 14 with the splined receptacle 54 carried by the coupling 27. With this arrangement, lateral displacement of the splined receptacle 54 will merely affect the slight displacement of the motor 14 carried by the plate 32 and thus avoid any material stress on the motor 32 that may damage or otherwise adversely affect its operation.

While only one embodiment of the invention has been illustrated and described, it is apparent that alterations, changes and modifications may be made without departing from the true scope and spirit thereof.

What is claimed is:

1. Driving means for an agitator having a tank and a vertical agitator shaft carrying agitating means disposed within the tank comprising a vertically disposed intermediate shaft rotatably supported in alignment with said agitator shaft, means for coupling said agitator shaft to one end of said intermediate shaft, a drive motor having a driven shaft extending downwardly therefrom, means for supporting said motor with said driven shaft in axial alignment with the other end of said intermediate shaft, and second coupling means carried by said other end of said intermediate shaft engaging said driven shaft, said motor supporting means permitting restricted displacement of said motor in a plane normal to said driven shaft to compensate for displacement of the last said engaging means produced by bending moments caused by rotation of said agitator.

2. Driving means for an agitator according to claim 1 wherein said intermediate shaft is supported by at least two spherical roller bearings.

3. Driving means for an agitator according to claim 2 wherein said roller bearings are capable of withstanding thrust and radial loads.

4. Driving means for an agitator according to claim 2 wherein said spherical roller bearings are affixed to a vertical column and said motor supporting means comprises a first horizontal plate affixed to said column and having an opening aligned with said intermediate shaft, a second horizontal plate overlying the first said plate and secured thereto, said second plate having an opening aligned with the opening in said first plate and being laterially displaceable relative thereto and said motor is hydraulic and is fixedly mounted on said second plate with the driven shaft extending through said openings and engaging said second coupling means.

5. Driving means for an agitator according to claim 4 wherein said first and second plates are spaced one from the other by a material having low coefficient of friction to permit ready displacement of said plates one relative to the other.

6. Driving means for an agitator according to claim 4 wherein said driven shaft has splines on the surface thereof and said second coupling means includes a splined socket slidably receiving and engaging said driven shaft.

7. Driving means for an agitator according to claim 4 wherein said first plate includes a pair of upwardly extending ears spaced from the opening therein and said second plate includes an elongated member extending from one edge thereof and engaging said ears.

8. Driving means for an agitator according to claim 4 wherein the first said coupling means comprises an elongated sleeve slidable engaging said agitator and intermediate shafts and shrink ring assemblies surrounding said sleeve and shrinking said sleeve firmly about each of said shafts to securely couple them one to the other.

9. Driving means for an agitator according to claim 4 wherein said second coupling means comprises an elongated sleeve, a splined socket secured to one end of said sleeve, the other end of said sleeve slidably engaging the upper end of said intermediate shaft and a shrink ring assembly surrounding said sleeve and shrinking said sleeve firmly about the intermediate shaft to securely couple the shaft to said second coupling means.

10. Driving means for a vertical shaft comprising a vertically disposed intermediate shaft rotatably supported in alignment with the first said vertical shaft, means for coupling the first said shaft to one end of said intermediate shaft, a drive motor having a driven shaft extending downwardly therefrom, means for supporting said motor with said driven shaft in axial alignment with the other end of said intermediate shaft, and second coupling means carried by said other end of said intermediate shaft engaging said driven shaft, said motor supporting means permitting restricted displacement of said motor in a plane normal to said driven shaft to compensate for displacement of the last said engaging means by bending moments caused by rotation of the first said shaft.

* * * * *